US009002243B2

(12) United States Patent
Fujita et al.

(10) Patent No.: US 9,002,243 B2
(45) Date of Patent: Apr. 7, 2015

(54) DEVELOPING DEVICE AND PROCESS UNIT AND IMAGE FORMING APPARATUS INCORPORATING SAME

(71) Applicants: Tetsumaru Fujita, Hyogo (JP); Ryuji Inoue, Hyogo (JP); Rie Mitani, Hyogo (JP)

(72) Inventors: Tetsumaru Fujita, Hyogo (JP); Ryuji Inoue, Hyogo (JP); Rie Mitani, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/208,406

(22) Filed: Mar. 13, 2014

(65) Prior Publication Data

US 2014/0270861 A1 Sep. 18, 2014

(30) Foreign Application Priority Data

Mar. 15, 2013 (JP) ..... 2013-053155

(51) Int. Cl.
*G03G 15/08* (2006.01)

(52) U.S. Cl.
CPC ..... *G03G 15/0877* (2013.01)

(58) Field of Classification Search
USPC ..... 399/286
See application file for complete search history.

(56) References Cited

U.S. PATENT DOCUMENTS

| | | | |
|---|---|---|---|
| 2008/0131174 | A1 | 6/2008 | Inoue et al. |
| 2009/0067887 | A1 | 3/2009 | Fujita et al. |
| 2012/0045254 | A1 | 2/2012 | Inoue et al. |

FOREIGN PATENT DOCUMENTS

| | | |
|---|---|---|
| JP | 4-347883 | 12/1992 |
| JP | 7-064391 | 3/1995 |
| JP | 2006-309128 | 11/2006 |
| JP | 2009-069367 | 4/2009 |

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

A developing device includes a toner bearer including a surface in which multiple recesses having a cross-sectional void rate of 50% or smaller are formed, a toner supply member to supply toner to the toner bearer, and a developer regulator disposed facing or in contact with the toner bearer and including a bent tip portion. The toner bearer has a surface roughness Ra within a range from 1.0 μm to 2.0 μm, and a surface area ratio within a range from 2.0 to 4.0. The developing device uses polymerized toner having a weight average particle diameter of 8.0 μm or smaller and an average circularity of 0.98 or greater.

7 Claims, 4 Drawing Sheets

DEVELOPING DEVICE AND PROCESS UNIT AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2013-053155, filed on Mar. 15, 2013, in the Japan Patent Office, the entire disclosure of which is hereby incorporated by reference herein.

BACKGROUND OF THE INVENTION

1. Technical Field

The present invention generally relates to an image forming apparatus and, more particularly, to a developing device incorporated in an image forming apparatus; and further relates to a process unit that includes a developing device. The image forming apparatus includes a copier, a printer, a facsimile machine, plotter, an ink-ejecting recording device, and a multifunction machine including at least two of these functions.

2. Description of the Background Art

For example, a conventional image forming apparatus is described in JP-2009-069367-A. In this image forming apparatus, an electrostatic latent image formed on the surface of a photoreceptor as a latent image bearer is developed by a developing device to obtain a toner image. The developing device has a developing roller as a toner bearer, a supply roller as a toner supply member, and a developer chamber as a toner containing compartment. The toner in the developer chamber is supplied to the developing roller by the supply roller. A developer regulator composed of a metal blade abuts against the developing roller. A toner layer composed of toner borne on the surface of the developing roller is regulated to a predetermined thickness by the developer regulator, and then is conveyed to a development range opposed to the photoreceptor in association with rotations of the developing roller. Then, the toner layer is transferred to an electrostatic latent image on the photoreceptor in the development range to contribute to developing.

JP-2006-309128-A proposes a developing roller used for such an imaging image forming apparatus of electrostatic photography. This developing roller has an infinite number of microscopic semispherical recesses formed in the surface thereof. According to JP-2006-309128-A, stress to the toner on the developing roller can be reduced by such a configuration.

In JP-H04-347883-A, there is a description that an adhesion amount of toner constituting a toner thin layer on the developing roller depends on an angle of approach of the toner concerning a developing device using a dry one-component developer.

SUMMARY OF THE INVENTION

In view of the foregoing, one embodiment of the present invention provides a developing device that includes a toner bearer to bear toner on a surface thereof, a toner supply member to supply toner to the toner bearer, and a developer regulator disposed facing or in contact with the toner bearer to adjust a layer thickness of toner carried on the toner bearer. Multiple recesses are formed in the surface of the toner bearer. The toner bearer has a surface roughness Ra within a range from 1.0 μm to 2.0 μm and a surface area ratio within a range from 2.0 to 4.0. A cross-sectional void rate of the recesses is 50% or smaller. The developer regulator includes a bent tip portion. The toner is polymerized toner having a weight average particle diameter of 8.0 μm or smaller and an average circularity of 0.98 or greater.

Another embodiment provides a process unit removably installed in an image forming apparatus. The process unit includes a latent image bearer on which a latent image is formed, and the above-described developing device. With the bent tip portion, a toner conveyance amount on the toner bearer is adjusted.

Yet another embodiment provides an image forming apparatus that includes the latent image bearer and the developing device described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
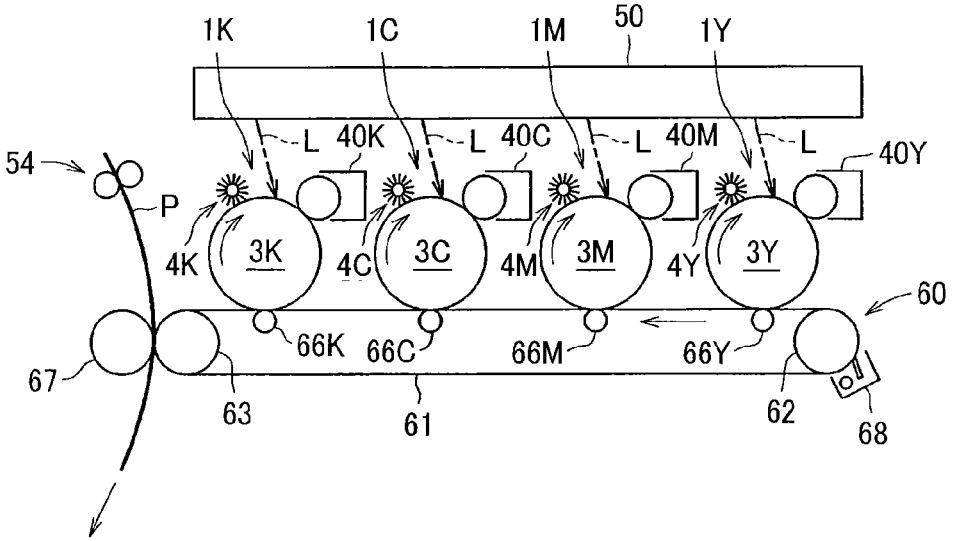
FIG. 1 is a schematic constituent view showing an image forming apparatus according to the present embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Inventors of the present invention experimentally recognize that it is possible that forming infinite number of microscopic semispherical recesses in the surface of a developing roller may be insufficient to suppress firm adhesion of toner particles or external additives to the surface of a developer regulator due to stress.

Specifically, since toner strongly scrapes against the developer regulator at the location where the developing roller abuts against the developer regulator, toner particles or external additives contained in the toner tends to be stuck to the surface of the developer regulator.

When substances, such as waxes or external additives, contained in the toner (hereinafter, sometimes collectively called "adhesion-causing substances") are stuck to the developer regulator, as described above, this causes a phenomenon in which the toner is trapped and fusion-bonded (hereinafter referred to "firm adhesion").

Additionally, when a roller having multiple recesses formed in the surface is used as the toner bearer, it is possible that the amount of toner conveyed (hereinafter "toner conveyance amount") becomes excessive and image density becomes uncontrollable.

In general, the toner conveyance amount is controlled by surface roughness of the developing roller in a one-component development system. However, in the case of a developing roller provided with recesses formed in the surface thereof, surface roughness of the developing roller is expected of abrading the adhesion-causing substance, and it is not preferred to change the surface shape. Accordingly, even when the toner conveyance amount can be controlled by setting an angle of approach of the toner within a predetermined range, it is difficult to suppress an excessive toner conveyance amount in such a developing device.

In the embodiment described below, the recesses formed in the surface of the toner bearer are made into a toner-sized concave-shape to enhance abrasive capability of the toner bearer, thereby attaining the effect of scraping off the adhering substances. Further, spherical toner is used, and the toner conveyance amount is adjusted with a bending angle of a tip of the developer regulator.

In the case of deformed toner, the toner conveyance amount changes steeply when the bending angle of the tip of the developer regulator is small, and the toner conveyance amount is stable when the bending angle of the tip of the developer regulator becomes a certain angle. The reason for this is believed to be that even when the bending angle of the tip is increased to make it hard to capture toner, a certain amount of toner is conveyed since the deformed toner hardly moves. Here, when multiple recesses are formed in the surface of the developing roller, the toner conveyance amount becomes excessive under the condition in which the roller has the effect of scraping off.

Thus, employing spherical toner is advantageous in that passage of toner through a gap between the developer regulator and the toner bearer varies depending on an intake property of the bending angle at the tip of the developer regulator, and the toner conveyance amount varies, making the toner conveyance amount smaller. It can be deemed that, since spherical toner particles easily roll over, toner is regulated by a blocking power of the developer regulator. That is, spherical toner, which more easily moves than deformed toner, relatively easily moves in the direction free from the blocking power receiving the blocking power.

In view of the foregoing, an object of the embodiment described below is to suppress the adhesion of adhesion-causing substance to the developer regulator while suppressing the excessive toner conveyance amount.

Referring now to the drawings, wherein like reference numerals designate identical or corresponding parts throughout the several views thereof, and particularly to FIG. 1, a multicolor electrophotographic image forming apparatus according to an embodiment of the present invention is described.

FIG. 1 is a schematic view showing an image forming apparatus according to the present embodiment, which is a multicolor laser printer, for example.

Initially, descriptions are given below of a multicolor electrophotographic image forming apparatus according to one embodiment of the present invention, which can be a laser printer, for example.

The image forming apparatus shown in FIG. 1 includes four process units 1Y, 1M, 1C, and 1K for forming yellow, magenta, cyan, and black toner images and further includes an optical writing unit 50 serving as a latent image forming unit, a pair of registration rollers 54, and a transfer unit 60. It is to be noted that suffixes Y, M, C, and K attached to each reference numeral indicate only that components indicated thereby are used for forming yellow, magenta, cyan, and black images, respectively, and hereinafter may be omitted when color discrimination is not necessary.

The optical writing unit 50 includes a light source constructed of four laser diodes corresponding to the respective colors, a polygon mirror that is a regular hexahedron, a polygon motor to rotate the polygon mirror, an f-θ lens, lenses, and reflection mirrors. The laser diode emits a laser beam L. As the polygon mirror rotates, the laser beam L is reflected on the faces of the polygon mirror, thus deflected, and reaches one of four photoreceptors described later. Surfaces of the four photoreceptors are scanned with the laser beams L respectively emitted from the four laser diodes.

Each process unit 1 includes a drum-shaped photoreceptor 3 serving as a latent image bearer (an image bearer) and a developing device 40 corresponding to the photoreceptor 3 in the same process unit 1. For example, the photoreceptors 3 each include an aluminum base pipe and an organic photosensitive layer overlying it and rotate clockwise in the drawing at a predetermined linear velocity, driven by a driving unit. The photoreceptors 3 are exposed in the dark by the optical writing unit 50 emitting the laser beams L, which are modulated according to image data transmitted from, for example, computers. Thus, electrostatic latent images for yellow, magenta, cyan, and black are formed thereon.

Figure 2:
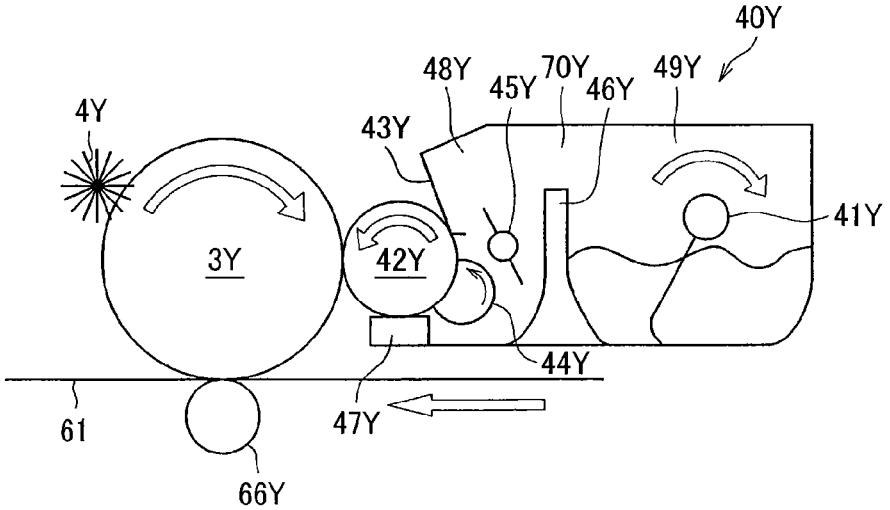
FIG. 2 is an enlarged view showing a process unit of the image forming apparatus shown in FIG. 1.

FIG. 2 is an enlarged view illustrating the process unit 1Y together with an intermediate transfer belt 61 of the transfer unit 60 shown in FIG. 1. As shown in FIG. 1, the process unit 1Y includes the photoreceptor 3Y, a charging brush roller 4Y, a discharge lamp, and the developing device 40Y. These components are housed in a common unit casing (i.e., a holder), thus together forming a process cartridge removably installed in a body of the image forming apparatus (i.e., an apparatus body).

A photoreceptor 3Y for yellow, which is charged and serves as the latent image bearer, is a drum of about 24 mm in diameter formed by coating the surface of a conductive base made of an aluminum bare tube with a photosensitive layer made of a negatively charged organic photoconductive material (OPC).

The charging brush roller 4Y includes a plurality of implanted fibers, and the tip thereof is scraped against the photoreceptor 3Y as the charging brush roller 4Y rotates counterclockwise in the drawing by the driving unit. The implanted fibers of the charging brush roller 4Y are formed by cutting conductive fibers into a predetermined length. Examples of a material of the conductive fibers include resin materials such as nylon-6 (registered trade mark), nylon-12 (registered trade mark), acrylic resin, vinylon, polyester and the like. Conductive particles such as carbon particles, metal fine powder, and the like are dispersed in these resin materials to provide a conductive property. In consideration of production cost and low Young's modulus, conductive fibers formed by dispersing carbon in nylon resin is preferred. In addition, carbon particles may be unevenly distributed in the fiber.

To the charging brush roller 4Y, a charging bias supply device including a power source and wiring is connected. To the charging brush roller 4Y, the charging bias supply device applies a charging bias that can be a voltage including direct voltage and alternating voltage overlapping it. In the image forming apparatus according to the present embodiment, the charging brush roller 4Y, the driving unit therefor, and the above-described charging bias supply device together form a charging device to charge the circumferential surface of the photoreceptor 3Y uniformly. In this configuration, electrical discharge is caused between each implanted fiber of the charging brush roller 4Y and the photoreceptor 3Y, and the surface of the photoreceptor 3Y is uniformly charged to a negative polarity, for example. It is to be noted that, among the components constituting the charging device, the charging brush roller 4Y is mounted in the process unit 1Y and removably installed in the apparatus body together with the photoreceptor 3Y and the like.

On the uniformly charged surface of the photoreceptor 3Y, the electrostatic latent image for yellow is formed by the above-described optical scanning and developed by the developing device 40Y into a yellow toner image.

The developing device 40Y uses nonmagnetic one-component developer consisting essentially of nonmagnetic toner (toner particles) and performs contact-type development. The developing device 40Y includes a developing chamber 48Y provided with a developing roller 42Y serving as a developer bearer, a supply roller 44Y serving as a developer supply member to supply developer to the developing roller 42Y, and a developer regulator 43Y to adjust the layer thickness of developer carried on the developing roller 42Y. An agitator 45Y is provided inside the developing chamber 48Y to agitate toner therein. A supply chamber 49Y provided with an agitator 41Y is disposed laterally adjacent to the developing chamber 48Y, and a partition 46Y divides the developing chamber 48Y from the supply chamber 49Y. To prevent toner in the developing chamber 48Y from reversely flowing to the supply chamber 49Y, the height of the partition 46Y is higher than those of the supply roller 44Y and the agitator 45Y. That is, an upper end of the partition 46Y is positioned higher than them.

The agitator 41Y in the supply chamber 49Y moves toner therein and supplies the toner to the developing chamber 48Y through an opening 70Y by rotating clockwise in FIG. 2.

The toner in the developing chamber 48Y is frictionally charged while being agitated by the agitator 45Y.

The supply roller 44Y is pressed against the developing roller 42Y, thus forming a nip having a width of about 0.5 mm, and supplies toner adhering thereto to the developing roller 42Y while rotating in the same direction as the direction of rotation of the developing roller 42Y. In other words, the supply roller 44Y rotates in the direction counter to the direction in which the surface of the supply roller 44Y moves. The surface of the supply roller 44Y is covered with a foamed material in which pores or cells are formed to efficiently bear toner contained in the developing chamber 48Y and to alleviate localization of pressure in the portion in contact with the developing roller 42Y, thus inhibiting deterioration of toner. A voltage of −100 V is applied to the supply roller 44Y as a supply bias having a polarity identical to toner charging polarity and offset relative to the electrical potential of the developing roller 42Y. The supply bias acts in the direction to press preliminarily charged toner against the developing roller 42Y in the contact portion with the developing roller 42Y. However, the voltage (supply bias) applied to the supply roller 44Y is not limited thereto. Depending on developer type, the potential may be identical to that of the developing roller 42Y, or the polarity may be inverted.

The developing roller 42Y can be produced by covering a metal core with an elastic layer of about 3 mm. The elastic layer can be formed with silicone rubber, for example. Further, the surface of the elastic layer is coated with a material that can be charged easily to the polarity opposite the polarity of developer. The elastic layer is configured to have a JIS-A hardness of 50 or lower (JIS K6253 Durometer Hardness type A) to attain a uniform contact state with the photoreceptor 3Y. The electrical resistivity thereof is $10^3$ to $10^{10}$ Ω·cm to enable the development bias to act. The developing roller 42Y has an arithmetic average roughness Ra of 0.2 μm to 2.9 μm to bear a necessary amount of developer. The developing roller 42Y rotates counterclockwise in the drawing and transports developer carried thereon to a position facing the developer regulator 43Y (i.e., a regulation gap) and a position facing the photoreceptor 3Y. The developing roller 42Y is disposed in contact with the photoreceptor 3Y.

For example, the developer regulator 43Y can be a metal leaf spring constructed of SUS304CSP or SUS301CSP (JIS standard); or phosphor bronze. The distal end (free end) of the developer regulator 43Y is disposed in contact with the surface of the developing roller 42Y with a pressing force of about 10 N/m$^2$ to 100 N/m$^2$ (see FIG. 5). While the developer carried on the developing roller 42Y passes through the developer regulator 43Y, the layer thickness of the developer is adjusted and thickened, and the developer is electrically charged by friction. Additionally, voltage offset to a polarity identical to toner charging polarity, relative to the electrical potential of the developing roller 42Y, may be applied to the developer regulator 43Y as a regulation bias.

In the developing device 40Y according to the present embodiment, at the position facing the photoreceptor 3Y, the developing roller 42Y rotates in the direction identical to the direction (clockwise in the drawing) in which the surface of the photoreceptor 3Y moves. As the developing roller 42Y rotates, the developer thereon is transported to the position facing the photoreceptor 3Y and transferred onto the surface of the photoreceptor 3Y by a latent image electrical field formed by the development bias applied to the developing roller 42Y and the latent image formed on the photoreceptor 3Y. Thus, the latent image is developed into a toner image.

A conductive sheet serving as a discharger is provided to a portion where developer remaining on the developing roller 42Y returns to the interior of the developing chamber 48Y. The conductive sheet is disposed in contact with the developing roller 42Y. While toner on the developing roller 42Y passes through a nip between the conductive sheet and the developing roller 42Y, electrical charges of normally charge polarity of toner is removed by triboelectric charging. With this action, electrostatic adsorption between the developing roller 42Y and toner is eliminated, thereby enabling the toner on the developing roller 42Y to return to the developing chamber 48Y. The conductive sheet can be formed with nylon, polytetrafluoroethylene (PTFE), urethane, polyethylene, or the like. In the present embodiment, the surface resistance is $10^5$ Ω/sq., and the thickness is 0.1 mm, for example.

The conductive sheet may be provided with a bias application device to apply thereto voltage of the polarity opposite the toner charging polarity.

The toner image developed on the photoreceptor 3Y is transferred onto the intermediate transfer belt 61 in a primary-transfer nip where the photoreceptor 3Y contacts the intermediate transfer belt 61. A certain amount of toner tends to remain untransferred on the photoreceptor 3Y that has passed through the primary-transfer nip.

The process unit 1Y used in the present embodiment employs a cleaner-less system. In cleaner-less systems, image forming processes are performed on image bearers, such as the photoreceptor 3Y, without collecting untransferred toner remaining on the image bearer by a member dedicated to cleaning. Additionally, the member dedicated to cleaning means a mechanism to transport the untransferred toner separated from the image bearer to a waste-toner container without supplying the untransferred toner again to the image bearer or transport it to the interior of the developing device for recycling.

Such a cleaner-less system will be described in detail below.

The cleaner-less system is broadly divided into a dispersing passing type, a temporary trapping type, and a combined type. Among these types, in the dispersing passing type, a untransferred toner remaining on the latent image bearer is scratched by using a dispersing member such as a brush scraping against the latent image bearer. Then, the untransferred toner remaining on the latent image bearer is electrostatically transferred to a developing member such as the developing roller in the development range where the toner remaining after transferring is opposed to the latent image bearer or immediately before transferring is opposed to be recovered in the developing device. The toner remaining after transferring passes through an optical writing position for writing latent images prior to this recovery, but this does not adversely affect writing of the latent images when an amount of the toner remaining after transferring is relatively small.

However, when a reversely charged toner is contained in the toner remaining after transferring, since the reversely charged toner, which is charged reversely to normal polarity, is not recovered onto the developing member, this toner causes background stains. For the purpose of suppressing the occurrence of background stains due to the reversely charged toner, it is preferred to dispose a toner charger for charging the untransferred toner remaining on the latent image bearer to a normal polarity. A position where the toner charger is disposed is preferably between a transferring position (e.g., primary transfer nip) and a dispersing position by the dispersing member, or between the dispersing position and the development range.

As the dispersing member, the following can be used. That is, a fixed brush having a plurality of implanted fibers composed of conductive fibers bonded to a plate or a unit casing, a brush roller in which a plurality of implanted fibers are installed to a metal rotation axis in a standing manner, and a roller having a roller portion made of conductive sponge. The fixed brush has an advantage of being low-cost since the amount of the implanted fibers is relatively small, but it cannot achieve sufficient charge uniformity when the fixed brush doubles as a charger for uniformly charging the latent image bearer. By contrast, the brush roller is favorable since it can achieve sufficient charge uniformity.

In temporary trapping type cleaner-less systems, the untransferred toner remaining on the latent image bearer is temporarily trapped by a trapper such as a rotating brush which is moved endlessly while bringing the surface into contact with the latent image bearer. Then, the untransferred toner remaining on the trapper is transferred again to the latent image bearer after the completion of print job or at the timing between sheets between the print jobs, and then the toner is electrostatically transferred to the developing member such as the developing roller to be recovered in the developing device. In the dispersing passing type, when a considerable amount of the toner remaining after transferring is present such as the time of forming solid images or the time after the occurrence of jamming, there is a possibility that the toner exceeds a capacity of returning to the developing member to cause deterioration of images. By contrast, in the temporary trapping type, such deterioration of images can be suppressed by returning the trapped toner to the developing member little by little.

In the combined type cleaner-less systems, the dispersing passing type is used in combination with the temporary trapping type. Specifically, the rotating brush that contacts the latent image bearer serves as both of the trapper and the dispersing member. While applying only direct voltage to the rotating brush to use the rotating brush as the dispersing member, the bias is switched from the direct voltage to direct voltage superimposed with alternating voltage to use the rotating brush also as the trapper as required. It is to be noted that, when the rotating brush serves as the dispersing member or the trapper, alternating voltage may be applied.

In the present embodiment, the process units 1 employ temporary trapping type cleaner-less systems. Specifically, for example, the photoreceptor 3Y of the process unit 1Y contacts the outer surface of the intermediate transfer belt 61 and forms the primary-transfer nip for yellow, while rotating clockwise in the drawing at a linear velocity of 124 mm/s. Then, electrical discharge is caused between the charging brush roller 4Y and the photoreceptor 3Y, and the surface of the photoreceptor 3Y is uniformly charged to −500 V, for example. Simultaneously, the untransferred toner adhering to the photoreceptor 3Y is transferred to, and temporarily trapped by, the implanted fibers of the charging brush roller 4Y due to synergistic effects of the charging bias and physical contact and scraping of the brush. After the completion of print job or at the timing between sheets, the charging bias is changed to a value suitable for reversely transferring the toner trapped by the implanted fibers, thereby transferring again the untransferred toner onto the photoreceptor 3Y. Subsequently, the toner is collected from the photoreceptor 3Y into the developing device 40Y via the developing roller 42Y.

The process unit 1M, 1C, and 1K have configurations similar to that of the process unit 1Y, and the descriptions thereof are omitted.

The transfer unit 60 is provided beneath the process units 1 in FIG. 1. In the transfer unit 60, the endless intermediate transfer belt 61, serving as a transfer medium, is stretched around multiple tension rollers and rotated counterclockwise in the drawing. The multiple tension rollers include a driven roller 62, a driving roller 63, and four primary-transfer bias rollers 66.

The driven roller 62, the primary-transfer bias rollers 66, and the driving roller 63 contact the back side (an inner circumferential face of the loop) of the intermediate transfer belt 61. The primary-transfer bias rollers 66 each include a metal core and an elastic member, such as sponge, overlying the metal core and are pressed against the photoreceptors 3, respectively, with the intermediate transfer belt 61 interposed therebetween. Thus, the primary-transfer nips are formed between the photoreceptors 3 and the intermediate transfer belt 61, where the photoreceptors 3 contact the intermediate transfer belt 61 for a predetermined length in the direction in which the intermediate transfer belt 61 moves.

The metal cores of the four primary-transfer bias rollers 66 receive primary-transfer biases controlled by a transfer bias power source performing constant current control. With this configuration, transfer electrical charges are given to the back side of the intermediate transfer belt 61 through the four primary-transfer bias rollers 66, and transfer electrical fields are generated in the respective primary-transfer nips between the photoreceptors 3 and the intermediate transfer belt 61. It is to be noted that, although roller-type primary transfer members are used in the description above, alternatively, brushes, blades, or the like may be used instead. Yet alternatively, transfer chargers may be used.

The toner images formed on the respective photoreceptors 3 are transferred therefrom and superimposed one on another on the intermediate transfer belt 61. Thus, a superimposed four-color toner image is formed on the intermediate transfer belt 61.

Additionally, a secondary-transfer bias roller 67 is provided in contact with the front side of a portion of the intermediate transfer belt 61 winding around the driving roller 63, thus forming a secondary-transfer nip therebetween. A voltage application unit that includes a power source and wiring applies a secondary-transfer bias to the secondary-transfer bias roller 67, and thus a secondary-transfer electric field is generated between the secondary-transfer bias roller 67 and the driving roller 63 that is grounded. The four-color toner image formed on the intermediate transfer belt 61 is transported to the secondary-transfer nip as the intermediate transfer belt 61 rotates.

Additionally, the image forming apparatus according to the present embodiment includes a sheet tray for containing a bundle of recording sheets (hereinafter "sheets P"). The sheets P contained in the sheet tray are fed from the top to a paper feeding path at a predetermined timing. A pair of registration rollers 54 pressing against each other is provided downstream from the sheet tray in a direction in which the sheet P is transported (hereinafter "sheet conveyance direction"), and the sheet P gets stuck in a nip between the registration rollers 54.

Although the pair of registration rollers 54 rotates to catch the sheet P in the nip, both rollers stop rotating immediately after catching a leading end of the sheet P. The sheet P is then transported to the secondary-transfer nip, timed to coincide with the four-color toner image formed on the intermediate transfer belt 61. In the secondary-transfer nip, the four-color toner image is transferred secondarily from the intermediate transfer belt 61 onto the sheet P at a time and becomes a full-color image on white color of the sheet P.

Subsequently, the sheet P carrying the multicolor toner image is transported to a fixing device, where the multicolor toner image is fixed on the sheet P.

A belt cleaning unit 68 is provided downstream from the secondary-transfer nip in the sheet conveyance direction to remove toner remaining on the intermediate transfer belt 61 after the secondary transfer process.

It is to be noted that, although a certain amount of toner remains untransferred on the photoreceptors 3 after the primary-transfer process, the respective process units 1 do not include a cleaning unit to remove untransferred toner. The untransferred toner remaining on the photoreceptors 3 are collected by the developing rollers 42 of the developing devices 40, and thus the cleaner-less system is employed.

In the above-described image forming apparatus according to the present embodiment, the four photoreceptors 3Y, 3M, 3C, and 3K serve as the latent image bearers or the image bearers to carry the latent image on the respective surfaces that move endlessly as the photoreceptors 3Y, 3M, 3C, and 3K rotate. The optical writing unit 50 serves as a latent image forming unit to form latent images on the respective photoreceptors 3 charged uniformly. The developing devices 40Y, 40M, 40C, and 40K serve as the developing devices to develop the latent images on the latent image bearers into toner images. The developing roller 42 serves as a toner bearer (i.e., a developer bearer) to develop the latent image with toner carried on its surface moving endlessly. The toner supply roller 44 serves as the toner supply member to supply toner to the toner bearer. The developer regulator 43 serves as the developer regulator that is disposed in contact with the toner bearer and adjusts the layer thickness of toner carried on the toner bearer. It is to be noted that the developer regulator may be disposed facing the developer bearer and contactless with the developer bearer. Additionally, the supply chamber 49 serves as the toner containing portion to contain toner.

Next, toner will be described.

In the present embodiment, toner having a weight average particle diameter (D4) within the range of 4.0 to 9.0 μm is employed. In cases of toners whose weight average particle diameters (D4) are less than 4.0 μm or more than 9.0 μm, the toner is not adequately held on the surface of the toner bearer. Therefore, the adhesion-causing substance adheres to the developer regulator, and it becomes difficult to scratch the adhesion-causing substance. In pulverization-type toner production, the surface of toner is shaved (which is called "surface pulverization"), and powdered particles having sizes of 0.6 to 2.0 μm, which are rather large, are easily generated.

Further, when the toner is produced by a polymerization method such as an emulsion aggregation method, a dissolution suspension method or a suspension polymerization, emulsion particle diameters converge into a certain particle diameter, but not-yet-converged emulsion particles tends to remain as particles of 0.6 to 2.0 μm.

The content of particles having a circle-equivalent diameter from 0.6 to 2.0 μm, measured by a flow particle image analyzer, is preferably within a range of 0 to 25%, and more preferably within a range of 0 to 15% on a number basis. The content of the particles is moreover preferably in the range of 0 to 8%. When the content of the particles having a circle-equivalent diameter of 0.6 to 2.0 μm, measured by a flow particle image analyzer, is in the range of 0 to 25% on a number basis, filming of the toner on the developing roller hardly occurs.

For example, the content, on a number basis, of particles having a circle-equivalent diameter measured by a flow particle image analyzer within a range from 0.6 to 2.0 μm can be controlled by the following methods in case of pulverized toner. That is, fine powder can be removed by using a microspin classifier in a classifying step or removed through a wet process such as a decanter type centrifuge.

The average circularity of toner is preferably in the range of 0.940 to 0.998, and more preferably in the range of 0.960 to 0.998. When the average circularity is in the range of 0.940 to 0.998, filming of toner on the developing roller hardly occurs.

When the toner is produced by a pulverization method, the toner often has the average circularity less than 0.940. The toner having the average circularity of 0.910 to 0.950 can be produced by adjusting conditions of pulverization of a mechanical pulverizer in pulverization. Further, the toner having the average circularity of 0.940 to 0.989 can be produced by heating the toner with a toner surface fusing system (e.g., Meteorainbow MR 10) after classifying. Further, the toner having the average circularity of 0.980 to 0.99 can be produced by subjecting the toner to hot bath at a temperature of glass transition temperature Tg (°) of the toner or more.

As a method for producing the toner, there are polymerization methods besides the pulverization method. Examples of the polymerization methods include a suspension polymerization method, a solution/suspension method, an emulsion aggregation method, and the like. When the toner is produced by the suspension polymerization method, toner particles having a high average circularity are obtained. Further, when the toner is produced by the solution/suspension method, the circularity is adjusted by controlling the conditions at the time of desolventizing. Further, when the toner is produced by the emulsion aggregation method, the circularity can be adjusted by adjusting the heating condition after aggregation.

As a releasing agent used as a material of the toner, all of publicly known materials can be used, and particularly desolated fatty acid type carnauba wax, montan wax and oxidized rice wax can be used alone or in combination thereof. As the carnauba wax, microcrystal wax is preferable and wax having an acid value of 5 or less, which becomes particles having a particle diameter of 1 μm or less in dispersing the wax in a toner binder, is preferable. Further, the montan wax generally refers to montan-based wax purified from a mineral, and it is preferred that the montan wax is microcrystal wax and has an acid value of 5 to 14 as with the carnauba wax. Further, oxidized rice wax is formed by oxidizing rice bran wax with air, and preferably has an acid value of 10 to 30. Alternatively, any of publicly known releasing agents, such as solid silicone wax, higher fatty acid higher alcohol, montan-based ester wax and low molecular weight polypropylene wax, can be used as a mixture thereof.

The amount used of these releasing agents is 1 to 20 parts by weight, and more preferably 3 to 10 parts by weight with respect to the toner resin component. A volume average particle diameter of the releasing agent before being dispersed in a toner binder is preferably in the range of 10 to 800 μm. When the volume average particle diameter is less than 10 μm, a particle diameter of the agent dispersed in the toner binder is small, making the releasing effect insufficient and causing offset easily. Further, when the volume average particle diameter is more than 800 μm, a particle diameter of the agent dispersed in the toner binder is large, resulting in an increase of deposition of the releasing agent on the toner surface, and malfunctions due to the fluidity of the toner and firm adhesion of the toner to the inside of the developing device easily occurs. The particle diameter of the releasing agent can be measured by using a laser diffraction/scattering type particle diameter distribution analyzer LA-920 manufactured by HORIBA, Ltd.

As a colorant to be contained in the binder resin for toner particles, any of publicly known dyes or pigments, such as carbon black, lamp black, iron black, aniline blue, phthalocyanine blue, phthalocyanine green, Hansa yellow G, rhodamine 6C lake, Calco oil blue, chrome yellow, quinacridon, benzidine yellow, rose bengal and triallyl methane-based dye, can be used alone or as a mixture thereof, and can be used as a black toner and a full color toner. The amount used of these colorants is usually 1 to 30% by weight, and preferably 3 to 20% by weight with respect to the toner resin component.

A charge control agent and a fluidity improver can be mixed in the toner as required. As the charge control agent, any of publicly known charge control agents such as a nigrosine dye, metal complex salt type dyes and quaternary ammonium salts can be used alone or as a mixture thereof. Further, examples of a negative charge control agent include metal salts of monoazo dye, and metal complexes of salicylic acid and dicarboxylic acid. The amount used of these charge control agents is 0.1 to 10 parts by weight, and preferably 1 to 5 parts by weight with respect to the toner resin component.

As the fluidity improver, any of publicly known fluidity improvers such as silicon oxide, titanium oxide, silicon carbide, aluminum oxide and barium titanate can be used alone or as a mixture thereof. The amounts used of these fluidity improvers are 0.1 to 5 parts by weight, and preferably 0.5 to 2 parts by weight with respect to the toner weight. Further, oil-containing silica and other publicly known external additives can also be used.

Descriptions are given below of a Coulter counter method used in measuring particle diameter distribution and a flow-type particle image analyzer. Volume average particle diameter and percentage by number of particles having a particle diameter of 5 μm or smaller can be measured by an instrument constructed of a Coulter Multisizer III, an interface from Nikkaki Bios Co., Ltd., and a computer PC9801 from NEC Corporation, both connected to the Coulter Multisizer III, to output number distribution and a volume distribution. As an electrolyte, a NaCl aqueous solution including an primary sodium chloride of 1% can be used. As a dispersant, 0.1 ml to 5 ml of surfactant, preferably alkylbenzene sulfonate, is added to 100 ml to 150 ml of the electrolyte. The solution is subjected to 1-minute dispersion by a ultrasonic dispersing device. Then, 100 ml to 200 ml of electrolyte solution is put in a separate beaker, and the above-described sample is put therein to attain a predetermined concentration. Using the Coulter Multisizer III, 3000 particles whose particle sizes are from 2 to 40 μm are measured with an aperture of 100 μm for particle size distribution on number basis. Subsequently, volume distribution and number distribution of particles whose particle sizes are from 2 to 40 μm are calculated, and volume average particle diameter on weight basis, which is called "weight average particle diameter D4 (center value at each channel is deemed a channel representative)", obtained from the volume distribution is calculated.

Circle-equivalent diameter and number-bases distribution can be measured by a SYSMEX flow-type particle image analyzer, FPIA-3000. The device and the method roughly described below, which are described in U.S. Pat. No. 5,721,433-A and JP-H08-136439-A.

Adjust primary sodium chloride into a NaCl aqueous solution of 1%, and filter it with a mesh opening size of 0.45 μm. After the filtering, add surfactant as a dispersant, preferably 0.1 ml to 5 ml of alkylbenzene sulfonate, to 50 ml to 100 ml of 1%-NaCl solution. Further, add 1 mg to 10 mg of the sample thereto. Subject the mixture to dispersion by the ultrasonic dispersing device for one minute, and calculate, as circle-equivalent diameter, the diameter of a circle having an area identical to the two-dimensional image area of the mixture in which the particle concentration is adjusted to 5000 to 15000 pieces/μl. Set the effective range to 0.6 μm or greater from pixel accuracy of a charge-coupled device (CCD) and acquire number of particles.

Average circularity of toner can be measured by a SYSMEX flow-type particle image analyzer, FPIA-3000. Specifically, put surfactant as a dispersant, preferably, 0.1 ml to 0.5 ml of alkylbenzene sulfonate in 100 ml to 150 ml of water from which impure solid materials are previously removed, and add 0.1 g to 0.5 g of the sample (toner) to the mixture. Disperse the mixture including the sample by an ultrasonic disperser for 1 to 3 min to prepare a dispersion liquid having a dispersion concentration from 3,000 to 10,000 pieces/μl, and measure the circularity using the above-mentioned instrument. The circularity can be calculated by dividing the circumferential length of a circle identical to a projected area with the circumferential length after projecting.

For example, pulverized toner is produced as follows.

That is, colored powder obtained by pulverization is classified by a classifier to remove fine powder, thereby adjusting the number basis content of particles having particle diameters ranging from 0.6 to 2.0 μm. Subsequently, an average circularity is adjusted by heat treatment as required. In this case, when the colored powder is heated without classifying, the particles of 0.6 to 2.0 μm in particle diameter are fusion-bonded, making the content control difficult. Therefore, it is preferred to process the colored powder in order of classifying and heat treatment in controlling the number basis content of particles having diameters ranging from 0.6 to 2.0 μm. In addition, toner produced by a pulverization method may be used in the present embodiment.

Next, experiments executed by the inventors are described.

A printing test machine used in the experiments has a configuration similar to that of the image forming apparatus according to the present embodiment. Toners A1 to A30 and Toners C1 to C2, described below, were produced.

[Toner A 1]

Prepared were 100.0 parts by weight of a polyester resin, 6 parts by weight of a quinacridon-based magenta pigment (C.I. Pigment Red 122), and 3 parts by weight of carnauba wax. These materials were mixed with 2 parts by weight of zinc salicylate as a charge control agent by a mixer, and the resulting mixture was melted and kneaded with a two roll mill, and further pulverized with ACM Pulverizer (manufactured by Hosokawa Micron Corporation) as a mechanical pulverizer. Consequently, colored powder whose weight average particle diameter was 6.7 μm, was obtained. The content of the colored powder in the particle diameter range of 2.0 to 4.0 μm was 48.3% on a number basis. Further, the content of the colored powder in the particle diameter range of 0.6 to 2.0 μm was 38.5% on a number basis. Thereafter, fine powder was removed from the colored powder by use of a microspin classifier (manufactured by NIPPON PNEUMATIC MFG., CO., LTD.) to obtain toner precursor colored powder.

Particles in the toner precursor colored powder were further classified. The toner precursor colored powder adjusted by classifying, 0.8 part by weight of hydrophobic silica, and 0.4 part by weight of titanium oxide were mixed with a Henschel mixer. Consequently, Toner A1 having a weight average particle diameter of 6.9 μm was obtained. The content of Toner A1 in the particle diameter range of 2.0 to 4.0 μm was 41.7% on a number basis. Further, the content of Toner A1 in the particle diameter range of 0.6 to 2.0 μm was 28.4% on a number basis. The average circularity was 0.913.

[Toner A2, Toner A3, Toner A4, Toner A5, Toner A6]

Toner A2, Toner A3, Toner A4, Toner A5, and Toner A6, whose contents of particles of 0.6 to 2.0 μm in particle diameter on a number basis are different, were obtained by making processing conditions in the microspin classifier different from those in producing Toner A1.

[Toner A7]

Toner A1 described above was heated at a feed rate of 5 kg/h and at a temperature of 170° C. by using a toner surface fusing system Meteorainbow MR 10 (manufactured by NIPPON PNEUMATIC MFG CO., LTD.). Thereby, Toner A7 having a weight average particle diameter of 6.9 μm was obtained. The content of Toner A7 in the particle diameter range of 0.6 to 2.0 μm was 28.0% on a number basis. Further, the average circularity of this toner was 0.951.

[Toner A8]

Toner A2 described above was heated at a feed rate of 5 kg/h and at a temperature of 170° C. by using the toner surface fusing system Meteorainbow MR 10. Thereby, Toner A8 having a weight average particle diameter of 7.0 μm was obtained. The content of Toner A8 in the particle diameter range of 0.6 to 2.0 μm was 20.1% on a number basis. Further, the average circularity of this toner was 0.950.

[Toner A9]

Toner A3 described above was heated at a feed rate of 5 kg/h and at a temperature of 170° C. by using the toner surface fusing system Meteorainbow MR 10. Thereby, Toner A9 having a weight average particle diameter of 7.0 μm was obtained. The content of Toner A9 in the particle diameter range of 0.6 to 2.0 μm was 10.1% on a number basis. Further, the average circularity of this toner was 0.949.

[Toner A10]

Toner A4 described above was heated at a feed rate of 5 kg/h and at a temperature of 170° C. by using the toner surface fusing system Meteorainbow MR 10. Thereby, Toner A10 having a weight average particle diameter of 7.1 μm was obtained. The content of Toner A10 in the particle diameter range of 0.6 to 2.0 μm was 5.3% on a number basis. Further, the average circularity of this toner was 0.952.

[Toner A11]

Toner A5 described above was heated at a feed rate of 5 kg/h and at a temperature of 170° C. by using the toner surface fusing system Meteorainbow MR 10. Thereby, Toner A11 having a weight average particle diameter of 7.1 μm was obtained. The content of Toner All in the particle diameter range of 0.6 to 2.0 μm was 3.2% on a number basis. Further, the average circularity of this toner was 0.950.

[Toner A12]

Toner A6 described above was heated at a feed rate of 5 kg/h and at a temperature of 170° C. by using the toner surface fusing system Meteorainbow MR 10. Thereby, Toner A12 having a weight average particle diameter of 7.2 μm was obtained. The content of Toner A12 in the particle diameter range of 0.6 to 2.0 μm was 0.4% on a number basis. Further, the average circularity of this toner was 0.952.

[Toner A13, Toner A19, Toner A25]

Toner A13, Toner A19, and Toner A25 were obtained in the same manner as in Toner A7 described above except for changing the feed rate and the treatment temperature in heat-treating in producing toner.

[Toner A14, Toner A20, Toner A26]

Toner A14, Toner A20, and Toner A26 were obtained in the same manner as in Toner A8 described above except for changing the feed rate and the treatment temperature in heat-treating in producing toner.

[Toner A15, Toner A21, Toner A27]

Toner A 15, Toner A21, and Toner A27 were obtained in the same manner as in Toner A9 described above except for changing the feed rate and the treatment temperature in heat-treating in producing toner.

[Toner A16, Toner A22, Toner A28]

Toner A16, Toner A22, and Toner A28 were obtained in the same manner as in Toner A10 described above except for changing the feed rate and the treatment temperature in heat-treating in producing toner.

[Toner A17, Toner A23, Toner A29]

Toner A 17, Toner A23, and Toner A29 were obtained in the same manner as in Toner A11 described above except for changing the feed rate and the treatment temperature in heat-treating in producing toner.

[Toner A18, Toner A24, Toner A30]

Toner A18, Toner A24, and Toner A30 were obtained in the same manner as in Toner A12 described above except for changing the feed rate and the treatment temperature in heat-treating in producing toner.

[Toner C1, Toner C2]

A toner C1 and Toner C2 were obtained in the same manner as in Toner A23 described above except for changing the rotor rotation speed of the mechanical pulverizer in producing toner.

Properties of these toners are shown in the following Table 1.

TABLE 1

| Toner | Weight average particle diameter (μm) | Content of particles of diameter 0.6 μm to 20 μm | Average circularity |
|---|---|---|---|
| A1 | 6.9 | 28.4 | 0.913 |
| A2 | 6.9 | 20.3 | 0.914 |
| A3 | 7.0 | 10.3 | 0.913 |
| A4 | 7.0 | 5.4 | 0.912 |
| A5 | 7.1 | 3.3 | 0.913 |
| A6 | 7.1 | 0.5 | 0.914 |
| A7 | 6.9 | 28.1 | 0.951 |
| A8 | 7.0 | 20.1 | 0.950 |
| A9 | 7.0 | 10.1 | 0.949 |
| A10 | 7.1 | 5.3 | 0.952 |
| A11 | 7.1 | 3.2 | 0.950 |
| A12 | 7.2 | 0.4 | 0.951 |
| A13 | 7.0 | 27.8 | 0.968 |
| A14 | 7.0 | 19.9 | 0.969 |
| A15 | 7.1 | 9.8 | 0.970 |
| A16 | 7.1 | 5.2 | 0.971 |
| A17 | 7.2 | 3.1 | 0.972 |
| A18 | 7.2 | 0.3 | 0.970 |
| A19 | 7.1 | 27.6 | 0.979 |
| A20 | 7.1 | 19.7 | 0.978 |
| A21 | 7.1 | 9.6 | 0.980 |
| A22 | 7.2 | 5.1 | 0.979 |
| A23 | 7.2 | 3.0 | 0.980 |
| A24 | 7.2 | 0.3 | 0.978 |
| A25 | 7.2 | 27.5 | 0.989 |
| A26 | 7.2 | 19.6 | 0.990 |
| A27 | 7.2 | 9.5 | 0.989 |
| A28 | 7.2 | 5.0 | 0.991 |
| A29 | 7.3 | 2.9 | 0.992 |
| A30 | 7.3 | 0.3 | 0.991 |
| C1 | 3.3 | 3.0 | 0.980 |
| C2 | 11.1 | 3.0 | 0.980 |

Further, as the developing roller 42K for black, 22 rollers named Nos. 001 to 022 were produced, which are described below. All of these rollers have an infinite number of recesses a little larger than the particle diameter of toner particles on their surface. Diameters of these recesses are about 10 μm to 15 μm. Depths of these recesses are about 4 μm to 6 μm.

Such rollers can be fabricated by, for example, forming a pattern of projections and depressions using a transfer-purpose mold prepared by electroforming, or forming recesses on a roller surface by a laser processing such as laser etching. Alternatively, a transferring plate whose surface is machined to form projections may be heated and pressed against a roller surface to form recesses. Yet alternatively, an arbitrary pattern of projections and depressions may be formed by irradiating a photoresist with light. Additionally, in a known roller production method, crosslinked resin particles are partially embedded in the roller surface to form a plurality of projections on the roller surface, and it is also possible to apply this method.

For example, a mold of a transcriptional body of the roller, having surface in which a plurality of projections are formed according to the above-mentioned method, is prepared, and the mold of a transcriptional body is abutted against the roller and the roller is heated to perform transferring, and thereby, a roller having multiple recesses formed by the above plurality of projections may be prepared. In any method, the size and the density of recesses are adjusted to a desired value.

The rollers 001 to 022 were produced as described below.

That is, first, fine particles and resin were dispersed in a solvent to prepare a slurry. Either inorganic fine particles or crosslinked resin particles may be used for the fine particles. Further, the inorganic fine particles may be silica, titanium oxide, aluminum oxide, zinc oxide, tin oxide, calcium carbonate, calcium phosphate, and/or cerium oxide. Further, the crosslinked resin particles may be spherical resin particles made of a material such as polymethyl methacrylate, polystyrene or polyurethane.

Although given resin that can achieve desired roller characteristics can be used, a polyurethane resin is preferred. The solvent is not particularly limited, and examples of the solvent include ketones such as methyl isobutyl ketone, methyl ethyl ketone, acetone and the like; aromatics such as toluene and the like; esters such as ethyl acetate and the like; and ethers such as tetrahydrofuran and the like.

After preparing the above-mentioned slurry, the slurry was applied onto a plate having the same surface area as that of the roller so as to have a desired thickness by use of a wire bar. Thereafter, as required, the uniformity of fine particles is controlled, for example, by ultrasonic vibration. Moreover, the solvent is removed through heating/drying, and thereby, a mold of a transcriptional body having projections at the surface thereof is prepared.

Next, multiple recesses were formed in the surface of the roller by heating the roller while pressing the roller against the transfer-purpose mold to transfer a projection of the transfer-purpose mold to the roller.

A specific method for manufacturing rollers will be described below.

[Roller 001]

Dispersed were 0.41 g of acrylic resin particles (particle diameter: 7 and 0.45 g of polyurethane resin in toluene to prepare a slurry. Next, the slurry was applied onto a plate having the same surface area as that of the roller by use of a wire bar in such a way that the thickness of the slurry is uniform. Thereafter, the slurry was subjected to ultrasonic vibration for 9 seconds to make dispersion of fine particles in the slurry uniform. Moreover, the slurry was heated while removing a solvent through heating/drying to transfer a plurality of projections of a transfer-purpose mold to the roller surface, and thereby, multiple recesses were formed at the roller surface. Thereby, a roller 001, in which surface roughness Ra was 0.9, a surface area ratio was 1.5, and a cross-sectional void rate of recesses was 53%, was obtained. Measurement of cross-sectional void rate of recesses is described later.

[Roller 002]

A roller 002 was obtained in the same manner as in the roller 001 except that the amount of the acrylic resin particles was changed to 0.47 g, the amount of the polyurethane resin was changed to 0.48 g, and a time to subject the resulting slurry to ultrasonic vibration was changed to 5 seconds. The roller 002 had surface roughness Ra of 0.8 and a surface area ratio of 2.1, and a cross-sectional void rate of recesses of the roller was 54%.

[Roller 003]

A roller 003 was obtained in the same manner as in the roller 001 except that the amount of the acrylic resin particles was changed to 0.51 g, the amount of the polyurethane resin was changed to 0.51 g, and the resulting slurry was not subjected to ultrasonic vibration. The roller 003 had surface roughness Ra of 1.0 and a surface area ratio of 2.8, and a cross-sectional void rate of recesses of the roller was 52%.

[Roller 004]

A roller 004 was obtained in the same manner as in the roller 001 except that the particle diameter of the acrylic resin particle was changed to 11 μm, the amount of the acrylic resin particles was changed to 0.38 g, the amount of the polyurethane resin was changed to 0.55 g, and a time to subject the resulting slurry to ultrasonic vibration was changed to 6 seconds. The roller 004 had surface roughness Ra of 1.4 and a surface area ratio of 1.5, and a cross-sectional void rate of recesses of the roller was 52%.

[Rollers 005 and 006]

A roller 005 and a roller 006 were obtained in the same manner as in the roller 004 except that the amount of the acrylic resin particles, the amount of the polyurethane resin, and a time to subject the resulting slurry to ultrasonic vibration were appropriately changed. The roller 005 had surface roughness Ra of 1.5 and a surface area ratio of 2.0, and a cross-sectional void rate of recesses of the roller was 53%. Further, the roller 006 had surface roughness Ra of 1.3 and a surface area ratio of 2.7, and a cross-sectional void rate of recesses of the roller was 54%.

[Roller 007]

A roller 007 was obtained in the same manner as in the roller 001 except that the particle diameter of the acrylic resin particle was changed to 15 μm, the amount of the acrylic resin particles was changed to 0.35 g, the amount of the polyurethane resin was changed to 0.59 g, and the resulting slurry was not subjected to ultrasonic vibration. The roller 007 had surface roughness Ra of 1.8 and a surface area ratio of 10.5, and a cross-sectional void rate of recesses of the roller was 51%.

[Rollers 008 and 009]

A roller 008 and a roller 009 were obtained in the same manner as in the roller 007 except that the amount of the acrylic resin particles, the amount of the polyurethane resin, and a time to subject the resulting slurry to ultrasonic vibration were appropriately changed. The roller 008 had surface roughness Ra of 1.7 and a surface area ratio of 2.1, and a cross-sectional void rate of recesses of the roller was 51%. Further, the roller 009 had surface roughness Ra of 1.9 and a surface area ratio of 2.9, and a cross-sectional void rate of recesses of the roller was 53%.

[Roller 010]

Dispersed were 0.39 g of acrylic resin particles (particle diameter: 7 μm), and 0.41 g of polyurethane resin in toluene to prepare a slurry. Next, the slurry was applied onto a plate having the same surface area as that of the roller by use of a wire bar in such a way that the thickness of the slurry is uniform. Thereafter, the slurry was subjected to ultrasonic vibration for 19 seconds to make dispersion of fine particles in the slurry uniform. Moreover, the solvent was removed through heating/drying, and thereby, a mold of a transcriptional body having projections at the surface thereof was formed. Then, multiple recesses were formed in the surface of the roller by heating the roller while pressing the roller against the transfer-purpose mold to transfer a plurality of projections of the transfer-purpose mold to the roller. Thereby, a roller 010, in which surface roughness Ra was 0.9, a surface area ratio was 1.5, and a cross-sectional void rate of recesses was 53%, was obtained.

[Rollers 011 to 022]

Rollers 011 to 022 were obtained in the same manner as in the roller 010 except that the particle diameter of the acrylic resin particle, the amount of the acrylic resin particles, the amount of the polyurethane resin, and a time to subject the resulting slurry to ultrasonic vibration were appropriately changed.

Further, the surface roughness Ra of each roller (Nos. 001 to 022) was measured in the following manner. That is, the surface of each roller was photographed at measuring pitches of 0.05 μm with a 50 times magnification lens by using a ultra-depth profile measuring microscope "VK-9500" (trade name, manufactured by KEYENCE CORPORATION). Then, after curvature corrections of the resulting photographed images were performed by using an analysis software Vk-Analyzer, the surface roughness Ra of the entire area was measured.

Further, a specific surface area of each roller was also measured by using the "VK-9500". Specifically, using the analysis software Vk-Analyzer, a specific surface area was determined by dividing the surface area S of the entire area by a theoretical surface area $S_o$ in the case of assuming that a roller surface is an ideal plane after performing the curvature corrections.

Further, the cross-sectional void rate of recesses of each roller was measured in the following manner. That is, the "VK-9500" and the analysis software Vk-Analyzer were used. First, a measurement plane area was set to 210.94 μm×281.35 μm corresponding to a measurement area of a 50 times magnification lens. Then, a surface area of a concavo-convex shape of the roller surface was determined based on data obtained by measuring a height at pitches of 0.05 μm by laser in the measurement area of the 50 times magnification lens. Then, the cross-sectional void rate of recesses was determined based on this surface area and the measurement plane area.

The above-mentioned toners and the above-mentioned rollers were mounted in various combinations on the printing test machine and printing tests was performed.

As the printing test machine, SP 310 (linear velocity 150 mm/s) manufactured by Ricoh Company, Ltd. was used. On each of various combinations of the toners and rollers, a chart image having an image area ratio of 5% was continuously printed on 2000 sheets of A4-size paper in a laboratory environment of 30° C. and 85% in humidity. After the printing, further one sheet of two-part position image was output, and the surface of the developer regulator and that of the developing roller at that time were observed. Then, degrees of firm adhesion of substances were rated. Further, after an adherent adhering to the surface of the developing roller was transferred to an adhesive tape, the tape was attached to a paper sheet, and the amount of toner (background fouling) was observed with a loupe. Further, the developing roller was observed with a loupe. Degrees of filming to the developing roller were evaluated based on these observation results.

The substances stuck to the developer regulator were rated according to the following four ranks.

Excellent: There is no streak in an image, a toner thin layer formed on the developing roller has a uniform thickness, and there is no substance stuck to the surface of the developer regulator.

Good: There is no streak in an image, a toner thin layer formed on the developing roller has a uniform thickness, and a substance stuck to the surface of the developer regulator is found a little.

Acceptable: There is no streak in an image, but wispy streaks are observed in a toner thin layer on the developing roller.

Bad: streaks can be recognized in an image.

The filming to the developing roller was rated according to the following four ranks.

Excellent: There is little background stain of toner, and adherents are found little on the surface of the developing roller.

Good: There is little background stain of toner, and a slight adherent of an external additive of toner is found on the surface of the developing roller.

Acceptable: The background stain of toner is observed a little, and an external additive of toner sticks uniformly to (films uniformly) the surface of the developing roller.

Not good: The background stain of toner is observed in a certain amount, and the surface shape of the developing roller is partially changed by the layer of toner external additives adhering thereto.

The above results of experiments are shown in the following Tables 2 to 6. It is to be noted that each of the rollers (009, 010, 011, 012, 013, 015, 016, 017, 018) shown in Table 4 was examined in combination with all of Toner A1 trough Toner A30. Similarly, each of the rollers shown in Tables 5 and 6 were examined in combinations with all of Toner A1 through Toner A30.

TABLE 2

| Roller | Cross-sectional void rate of recesses | Ra | Specific surface area | Toner | Weight average particle diameter (μm) | Sticking to developer regulator | Filming |
|---|---|---|---|---|---|---|---|
| 001 | 53 | 0.9 | 1.5 | A13 | 7.0 | Acceptable | Excellent |
| 002 | 54 | 0.8 | 2.1 | A13 | 7.0 | Good | Excellent |
| 003 | 52 | 1.0 | 2.8 | A13 | 7.0 | Acceptable | Excellent |
| 004 | 52 | 1.4 | 1.5 | A13 | 7.0 | Good | Excellent |
| 005 | 53 | 1.5 | 2.0 | A13 | 7.0 | Good | Excellent |
| 006 | 54 | 1.3 | 2.7 | A13 | 7.0 | Good | Excellent |
| 007 | 51 | 1.8 | 1.5 | A13 | 7.0 | Acceptable | Excellent |
| 008 | 51 | 1.7 | 2.1 | A13 | 7.0 | Good | Excellent |
| 009 | 53 | 1.9 | 2.9 | A13 | 7.0 | Acceptable | Excellent |
| 010 | 70 | 0.9 | 1.5 | A13 | 7.0 | Good | Excellent |
| 011 | 69 | 0.9 | 2.1 | A13 | 7.0 | Good | Excellent |
| 012 | 70 | 0.9 | 2.8 | A13 | 7.0 | Good | Excellent |
| 013 | 68 | 1.5 | 1.5 | A13 | 7.0 | Good | Excellent |
| 014 | 70 | 1.5 | 2.1 | A13 | 7.0 | Excellent | Excellent |
| 015 | 70 | 1.4 | 2.8 | A13 | 7.0 | Good | Excellent |
| 016 | 69 | 1.8 | 1.5 | A13 | 7.0 | Good | Excellent |
| 017 | 70 | 1.9 | 2.1 | A13 | 7.0 | Good | Excellent |
| 018 | 68 | 1.7 | 2.8 | A13 | 7.0 | Good | Excellent |
| 019 | 70 | 0.6 | 2.1 | A13 | 7.0 | Bad | Excellent |
| 020 | 69 | 1.4 | 1.2 | A13 | 7.0 | Bad | Excellent |
| 021 | 68 | 1.4 | 3.5 | A13 | 7.0 | Bad | Excellent |
| 022 | 70 | 2.2 | 2.1 | A13 | 7.0 | Bad | Excellent |

TABLE 3

| Roller | Cross-sectional void rate of recesses | Ra | Specific surface area | Toner | Weight average particle diameter (μm) | Sticking to developer regulator | Filming |
|---|---|---|---|---|---|---|---|
| 014 | 70 | 1.5 | 2.1 | A1 | 6.9 | Excellent | Not good |
| | | | | A2 | 6.9 | Excellent | Acceptable |
| | | | | A3 | 7.0 | Excellent | Acceptable |
| | | | | A4 | 7.0 | Excellent | Acceptable |
| | | | | A5 | 7.1 | Excellent | Acceptable |
| | | | | A6 | 7.1 | Excellent | Acceptable |
| | | | | A7 | 6.9 | Excellent | Acceptable |
| | | | | A8 | 7.0 | Excellent | Acceptable |
| | | | | A9 | 7.0 | Excellent | Acceptable |
| | | | | A10 | 7.1 | Excellent | Good |
| | | | | A11 | 7.1 | Excellent | Good |
| | | | | A12 | 7.2 | Excellent | Good |
| | | | | A13 | 7.0 | Excellent | Acceptable |
| | | | | A14 | 7.0 | Excellent | Acceptable |
| | | | | A15 | 7.1 | Excellent | Good |
| | | | | A16 | 7.1 | Excellent | Good |
| | | | | A17 | 7.2 | Excellent | Good |
| | | | | A18 | 7.2 | Excellent | Good |
| | | | | A19 | 7.1 | Excellent | Acceptable |
| | | | | A20 | 7.1 | Excellent | Acceptable |
| | | | | A21 | 7.1 | Excellent | Good |
| | | | | A22 | 7.2 | Excellent | Excellent |
| | | | | A23 | 7.2 | Excellent | Excellent |
| | | | | A24 | 7.2 | Excellent | Excellent |
| | | | | A25 | 7.2 | Excellent | Acceptable |
| | | | | A26 | 7.2 | Excellent | Acceptable |
| | | | | A27 | 7.2 | Excellent | Good |
| | | | | A28 | 7.2 | Excellent | Excellent |
| | | | | A29 | 7.3 | Excellent | Excellent |
| | | | | A30 | 7.3 | Excellent | Excellent |
| | | | | C1 | 3.3 | Bad | Excellent |
| | | | | C2 | 11.1 | Bad | Excellent |

TABLE 4

| Roller | Cross-sectional void rate of recesses | Ra | Specific surface area | Toner | Weight average particle diameter (μm) | Sticking to developer regulator | Filming |
|---|---|---|---|---|---|---|---|
| 009 | 53 | 1.9 | 2.9 | A1 | 6.9 | Good | Not good |
| 010 | 70 | 0.9 | 1.5 | A2 | 6.9 | Good | Acceptable |
| 011 | 69 | 0.9 | 2.1 | A3 | 7.0 | Good | Acceptable |
| 012 | 70 | 0.9 | 2.8 | A4 | 7.0 | Good | Acceptable |
| 013 | 68 | 1.5 | 1.5 | A5 | 7.1 | Good | Acceptable |
| 015 | 70 | 1.4 | 2.8 | A6 | 7.1 | Good | Acceptable |
| 016 | 69 | 1.8 | 1.5 | A7 | 6.9 | Good | Acceptable |
| 017 | 70 | 1.9 | 2.1 | A8 | 7.0 | Good | Acceptable |
| 018 | 68 | 1.7 | 2.8 | A9 | 7.0 | Good | Acceptable |
| | | | | A10 | 7.1 | Good | Good |
| | | | | A11 | 7.1 | Good | Good |
| | | | | A12 | 7.2 | Good | Good |
| | | | | A13 | 7.0 | Good | Acceptable |
| | | | | A14 | 7.0 | Good | Acceptable |
| | | | | A15 | 7.1 | Good | Good |
| | | | | A16 | 7.1 | Good | Good |
| | | | | A17 | 7.2 | Good | Good |
| | | | | A18 | 7.2 | Good | Good |
| | | | | A19 | 7.1 | Good | Acceptable |
| | | | | A20 | 7.1 | Good | Acceptable |
| | | | | A21 | 7.1 | Good | Good |
| | | | | A22 | 7.2 | Good | Excellent |
| | | | | A23 | 7.2 | Good | Excellent |
| | | | | A24 | 7.2 | Good | Excellent |
| | | | | A25 | 7.2 | Good | Acceptable |
| | | | | A26 | 7.2 | Good | Acceptable |
| | | | | A27 | 7.2 | Good | Good |
| | | | | A28 | 7.2 | Good | Excellent |
| | | | | A29 | 7.3 | Good | Excellent |
| | | | | A30 | 7.3 | Good | Excellent |

TABLE 5

| Roller | Cross-sectional void rate of recesses | Ra | Specific surface area | Toner | Weight average particle diameter (μm) | Sticking to developer regulator | Filming |
|---|---|---|---|---|---|---|---|
| 002 | 54 | 0.8 | 2.1 | A1 | 6.9 | Good | Not good |
| 004 | 52 | 1.4 | 1.5 | A2 | 6.9 | Good | Acceptable |
| 005 | 53 | 1.5 | 2.0 | A3 | 7.0 | Good | Acceptable |
| 006 | 54 | 1.3 | 2.7 | A4 | 7.0 | Good | Acceptable |
| 008 | 51 | 1.7 | 2.1 | A5 | 7.1 | Good | Acceptable |
| | | | | A6 | 7.1 | Good | Acceptable |
| | | | | A7 | 6.9 | Good | Acceptable |
| | | | | A8 | 7.0 | Good | Acceptable |
| | | | | A9 | 7.0 | Good | Acceptable |
| | | | | A10 | 7.1 | Good | Good |
| | | | | A11 | 7.1 | Good | Good |
| | | | | A12 | 7.2 | Good | Good |
| | | | | A13 | 7.0 | Good | Acceptable |
| | | | | A14 | 7.0 | Good | Acceptable |
| | | | | A15 | 7.1 | Good | Good |
| | | | | A16 | 7.1 | Good | Good |
| | | | | A17 | 7.2 | Good | Good |
| | | | | A18 | 7.2 | Good | Good |
| | | | | A19 | 7.1 | Good | Acceptable |
| | | | | A20 | 7.1 | Good | Acceptable |
| | | | | A21 | 7.1 | Good | Good |
| | | | | A22 | 7.2 | Good | Excellent |
| | | | | A23 | 7.2 | Good | Excellent |
| | | | | A24 | 7.2 | Good | Excellent |
| | | | | A25 | 7.2 | Good | Acceptable |
| | | | | A26 | 7.2 | Good | Acceptable |
| | | | | A27 | 7.2 | Good | Good |
| | | | | A28 | 7.2 | Good | Excellent |
| | | | | A29 | 7.3 | Good | Excellent |
| | | | | A30 | 7.3 | Good | Excellent |

TABLE 6

| Roller | Cross-sectional void rate of recesses | Ra | Specific surface area | Toner | Weight average particle diameter (μm) | Sticking to developer regulator | Filming |
|---|---|---|---|---|---|---|---|
| 001 | 53 | 0.9 | 1.5 | A1 | 6.9 | Acceptable | Not good |
| 003 | 52 | 1.0 | 2.8 | A2 | 6.9 | Acceptable | Acceptable |
| 007 | 51 | 1.8 | 1.5 | A3 | 7.0 | Acceptable | Acceptable |
| 009 | 53 | 1.9 | 2.9 | A4 | 7.0 | Acceptable | Acceptable |
| | | | | A5 | 7.1 | Acceptable | Acceptable |
| | | | | A6 | 7.1 | Acceptable | Acceptable |
| | | | | A7 | 6.9 | Acceptable | Acceptable |
| | | | | A8 | 7.0 | Acceptable | Acceptable |
| | | | | A9 | 7.0 | Acceptable | Acceptable |
| | | | | A10 | 7.1 | Acceptable | Good |
| | | | | A11 | 7.1 | Acceptable | Good |
| | | | | A12 | 7.2 | Acceptable | Good |
| | | | | A13 | 7.0 | Acceptable | Acceptable |
| | | | | A14 | 7.0 | Acceptable | Acceptable |
| | | | | A15 | 7.1 | Acceptable | Good |
| | | | | A16 | 7.1 | Acceptable | Good |
| | | | | A17 | 7.2 | Acceptable | Good |
| | | | | A18 | 7.2 | Acceptable | Good |
| | | | | A19 | 7.1 | Acceptable | Acceptable |
| | | | | A20 | 7.1 | Acceptable | Acceptable |
| | | | | A21 | 7.1 | Acceptable | Good |
| | | | | A22 | 7.2 | Acceptable | Excellent |
| | | | | A23 | 7.2 | Acceptable | Excellent |
| | | | | A24 | 7.2 | Acceptable | Excellent |
| | | | | A25 | 7.2 | Acceptable | Acceptable |
| | | | | A26 | 7.2 | Acceptable | Acceptable |
| | | | | A27 | 7.2 | Acceptable | Good |
| | | | | A28 | 7.2 | Acceptable | Excellent |
| | | | | A29 | 7.3 | Acceptable | Excellent |
| | | | | A30 | 7.3 | Acceptable | Excellent |

As shown in Table 2, when Toner A13 having the weight average particle diameter (D4) of 7.0 μm was used, in 13 rollers among Rollers 001 to 018, the occurrence of substances stuck to the developer regulator occurred little. Filming to the developing roller did not occur. On the other hand, in 4 rollers of Rollers 019 to 022, the occurrence of substances stuck to the developer regulator caused a streak in the image although the filming to the developing roller did not occur.

As shown in Table 3, when the Roller 014 was used, if the weight average particle diameter (D4) of the toner was in the range of 6.9 to 7.3 μm, a streak in the image resulting from the occurrence of substances stuck to the developer regulator did not occur. On the other hand, if the weight average particle diameter (D4) of the toner was in the range of 3.3 μm or 11.1 μm, a streak in the image resulting from the occurrence of substances stuck to the developer regulator occurred.

Further, as shown in Table 4, when the Rollers 009, 010, 011, 012, 013, 015, 016, 017, 018 were used, if the weight average particle diameters of the toners were in the range of 6.9 to 7.3 μm, the occurrence of substances stuck to the developer regulator occurred little.

Further, as shown in Table 5, also when the Rollers 002, 004, 005, 006, 008 were used, if the weight average particle diameters of the toners were in the range of 6.9 to 7.3 μm, the occurrence of substances stuck to the developer regulator occurred little.

Further, as shown in Table 6, also when the Rollers 001, 003, 007, 009 were used, if the weight average particle diameters of the toners were in the range of 6.9 to 7.3 μm, the occurrence of substances stuck to the developer regulator occurred little.

From the above description, it can be deemed that the occurrence of firm adhesion to the developer regulator is effectively suppressed using toner and the developing roller, serving as a toner bearer satisfying the following requirements. That is, the weight average particle diameter of the toner is in the range from 4.0 μm to 9.0 μm. Regarding the developing roller, multiple recesses are formed in the surface thereof, the surface roughness Ra of the developing roller is adjusted to the range from 0.7 μm to 2.0 μm, the surface area ratio is adjusted to the range of 1.3 to 3.0, and the cross-sectional void rate of recesses is adjusted to the range from 50% to 80%.

Thus, in the image forming apparatus according to the present embodiment, toner having a weight average particle diameter of 4.0 μm to 9.0 μm is loaded into the each color process unit 1. Further, the developing roller 42 mounted on the each color process unit 1 satisfies the requirements of: multiple recesses are formed in the surface thereof, in which the surface roughness Ra is adjusted to the range of 0.7 μm to 2.0 μm; the surface area ratio is adjusted to the range of 1.3 to 3.0; and the cross-sectional void rate of recesses is adjusted to the range of 50 to 80%.

It is to be noted that, in order to identify the reason why experimental results as shown in Tables 2 to 6 were obtained, the present inventors photographed the behavior of the toner between the developing roller 42K and the developer regulator 43K with a high-speed camera while performing test printing in the printing test machine. Consequently, a remarkable phenomenon was found in the behavior of toner when the following conditions are satisfied. That is, the conditions are that the weight average particle diameter of toner particles is 4.0 to 9.0 μm, the surface roughness Ra of the developing roller is 0.7 to 2.0 μm, the surface area ratio of the developing roller is 1.3 to 3.0, and the cross-sectional void rate of recesses is 50 to 80%.

Figure 3:
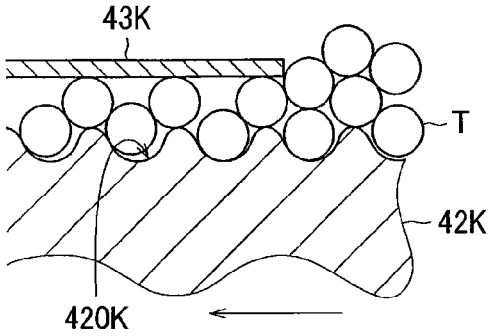
FIG. 3 is an enlarged schematic view showing a surface configuration of a developing roller, together with a developer regulator, according to an embodiment.

In the case of such conditions, as shown in FIG. 3, an infinite number of recesses 420K (depth: 4 to 6 μm, diameter: 10 to 15 μm) formed in the surface of the developing roller 42K are arranged with non-recess portions sandwiched therebetween, and the size (a mean size) of each non-recess portion is smaller than the diameter of the recess 420K. Not all recesses 420K are arranged with non-recess portions sandwiched therebetween, and some recesses 420K become continuous with one another. However, on average, the recesses 420K are arranged with the above-described non-recess portions sandwiched therebetween. As shown in FIG. 3, between the surface of the developing roller 42K and the developer regulator 43K, a few (1 to 3) toner particles T occupy the recess 420K, piled on top of another in the depth direction of the recess 420K. The toner particles T line like peas in a field peas. In the above-mentioned state, the top toner particle T scrapes against the surface of the developer regulator 43K independently, and substances adhering to the surface of the developer regulator 43K are scraped off. By such effects of scraping off, firm adhesion of toner particles or external additives to the developer regulator 43K was suppressed.

Figure 4:
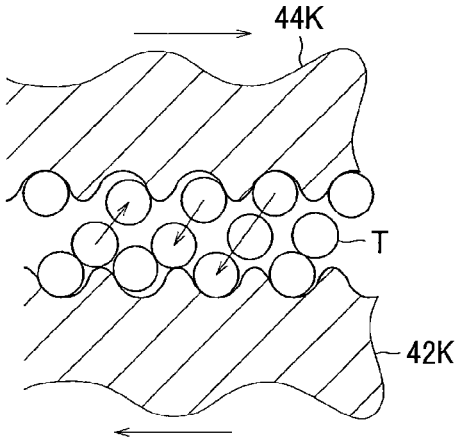
FIG. 4 is an enlarged schematic view showing a location where the developer regulator abuts against a supply roller shown in FIG. 2.

It is to be noted that, if the same toner particles T are kept scraped against the surface of the developer regulator 43K over a long time, the toner particles are stuck to the surface of the developer regulator 43K due to softening associated with heat generation. However, when the toner particles T filling the recess 420K pass through a location where the developer regulator 43K abuts against the developing roller 42K, they are scraped off from the recess 420K by the surface of the supply roller 44K having a foamed cell structure like a sponge, as shown in FIG. 4. Then, new toner particles T present in a cell of the supply roller 44K are put in the recesses 420K. In this way, the toner particles T in the recess 420K are replaced, and thereby, the occurrence of firm adhesion of toner particles to the surface of the developer regulator 43K is suppressed.

In view of these results of the experiments, the image forming apparatus according to the present embodiment is provided with conditions that the toner weight average particle diameter is 4.0 to 9.0 μm, the surface roughness Ra of the developing roller 42 is 0.7 to 2.0 μm, the surface area ratio of the developing roller 42 is 1.3 to 3.0, and the cross-sectional void rate of recesses of the developing roller 42 is 50% to 80%. With this configuration, distribution of recesses can be suitable for temporarily holding several toner particles within the recess and causing the top toner particle to scrape against the surface of the developer regulator 43 to abrade the stuck substances thereon. Accordingly, firm adhesion of toner particles or external additives to the surface of the developer regulator 43 can be suppressed.

It is to be noted that the surface roughness Ra of the developing roller 42 is preferably in the range of 1.0 to 2.0 μm, and more preferably, in the range of 1.3 to 1.7 μm.

Further, in the developing roller 42, the content of the particles whose circle-equivalent diameters measured by a flow particle image analyzer are 0.6 to 2.0 μm is preferably in the range of 0 to 25% on a number basis, and more preferably in the range of 0 to 15%. The content of the particles is more preferably in the range of 0 to 15%. The content of the particles is moreover preferably in the range of 0 to 8%. In addition, adjustment of the content can be realized by adjusting a level of pulverization and classification in a pulverizer/classifier a model IDS-2 (manufactured by NIPPON PNEUMATIC MFG. CO., LTD.) in producing a toner.

Figure 5:
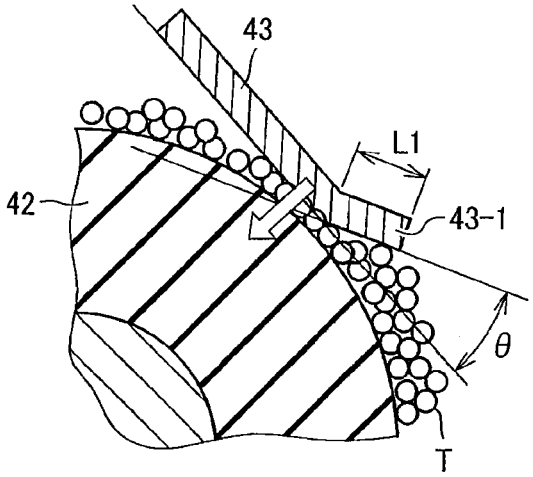
FIG. 5 is a cross-sectional view that schematically illustrates the developing roller and a bent tip portion of the developer regulator shown in FIG. 2.

FIG. 5 is a cross-sectional view schematically showing a location where the developer regulator 43 abuts against the developing roller 42.

Referring to FIG. 5, the developer regulator 43 is bent at a tip. That is, the developer regulator 43 includes a bent tip portion 43-1. In FIG. 5, symbol θ represents a bending angle at the tip, and symbol L1 represents a length of the bent tip portion 43-1. As described above, a material of the developer regulator 43 can be stainless steel or other metal material. In FIG. 5, the diagonally shaded areas represent a target value range of the toner conveyance amount.

Figure 6:
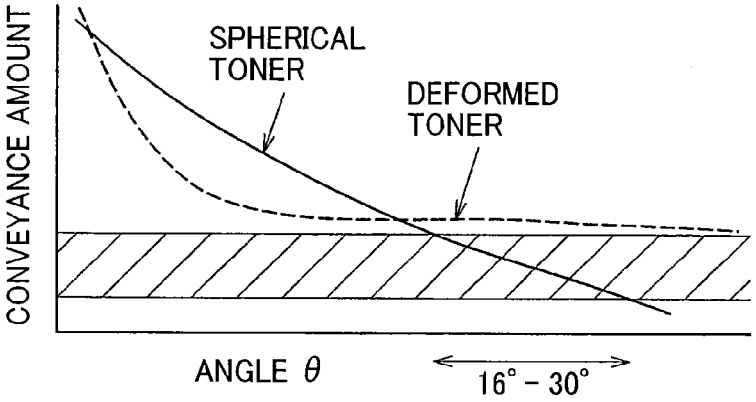
FIG. 6 is a graph showing a relation between an angle 0 of the developer regulator shown in FIG. 5 and a toner conveyance amount.

FIG. 6 is a graph showing a relation between the angle θ of the developer regulator 43 shown in FIG. 5 and the toner conveyance amount.

In FIG. 6, the horizontal axis represents the angle θ (°), and the vertical axis represents the conveyance amount (g/m$^2$) of toner. A solid curve is drawn by plotting measurements of the toner conveyance amount of polymerized toner (spherical toner), and a broken curve is drawn by plotting measurements of the toner conveyance amount of deformed toner. Specific results of the test conducted by using SP 310 manufactured by Ricoh Company, Ltd. are shown in FIG. 7.

Test conditions are as follows. The toner used in the test is polymerized toner having a particle diameter of 6 μm and a average circularity of 0.97 or more, to which an external additive having a small diameter of about 20 nm and an external additive having a medium diameter of about 50 nm are added.

The developer regulator 43 used in the test is a stainless steel sheet having a plate thickness of 0.1 mm, takes on a bending shape at the tip (refer to FIG. 5), and a voltage of −100 V relative to that of the developing roller 42 was applied to the developer regulator 43.

The developing roller 42 used in the test is an elastic roller having a linear velocity ratio of a developing nip of 1.4.

Criteria of rating are as follows.

The toner conveyance amount was measured as follows. While varying the bending angle θ of the developer regulator 43 at intervals of 2°, white solid images were printed with a toner loading amount of 60 g under a neutral environment (NN environment) of a temperature of 23° C. and a humidity of 55% RH, and the toner conveyance amount (g/m$^2$) on the developing roller 42 was measured midway the printing. The target conveyance amount was set to 4 to 6 g/m$^2$.

Filming was rated as "not good" when the charge is reduced to two-thirds of initial charge and rated as "bad" when the charge is reduced to one-half of initial charge since the charge is lowered by the occurrence of filming.

To evaluate clogging of the developer regulator 43, a chart image of 3PJ and an image area ratio of 2% were printed on 5000 sheets under a hot and humid environment (HH environment), a temperature of 30° C. and a humidity of 80% RH. The presence or absence of streak and the number of streaks on a thin layer of the developing roller 42 were observed for every 100 sheets.

Measurement of the coarse powder was performed by using a Coulter counter described above (particle diameter distribution on a number basis).

Figure 7A:
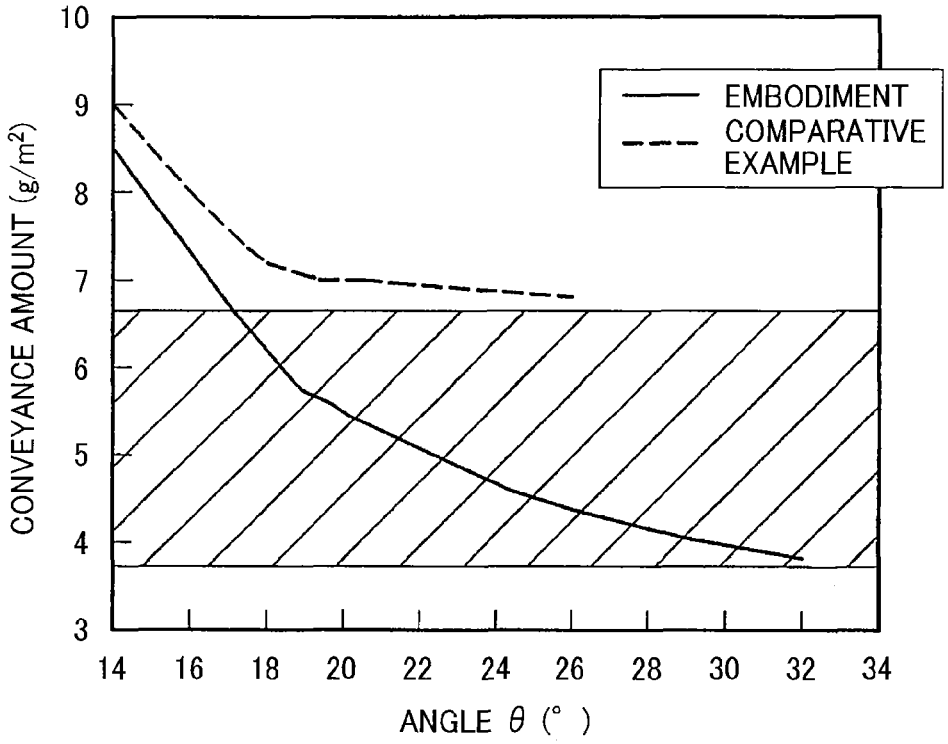
FIG. 7A is graph showing test results corresponding to FIG. 6, when regulating pressure exerted by the developer regulator is set to an upper limit.

FIG. 7A shows the test results in the case where the pressure (refer to a hollow arrow in FIG. 5) applied to the developing roller 42 by the developer regulator 43 is set to 60 N (upper limit). A solid line curve is drawn by plotting measurements of the toner conveyance amount of Embodiment (spherical toner: toner for IPSiO SPC 731 manufactured by Ricoh Company, Ltd., average particle diameter 6 μm), and a broken line curve is drawn by plotting measurements of the toner conveyance amount of Comparative Examples (deformed toner: toner for IPSiO SPC 310H manufactured by Ricoh Company, Ltd., average particle diameter 6 μm). In Embodiment, the toner conveyance amounts fall within the range of 4 to 6.5 g/m$^2$ at angles θ of 18° to 30°. In Comparative Examples, the toner conveyance amounts do not fall below 7 g/m$^2$ regardless of the angle θ.

Figure 7B:
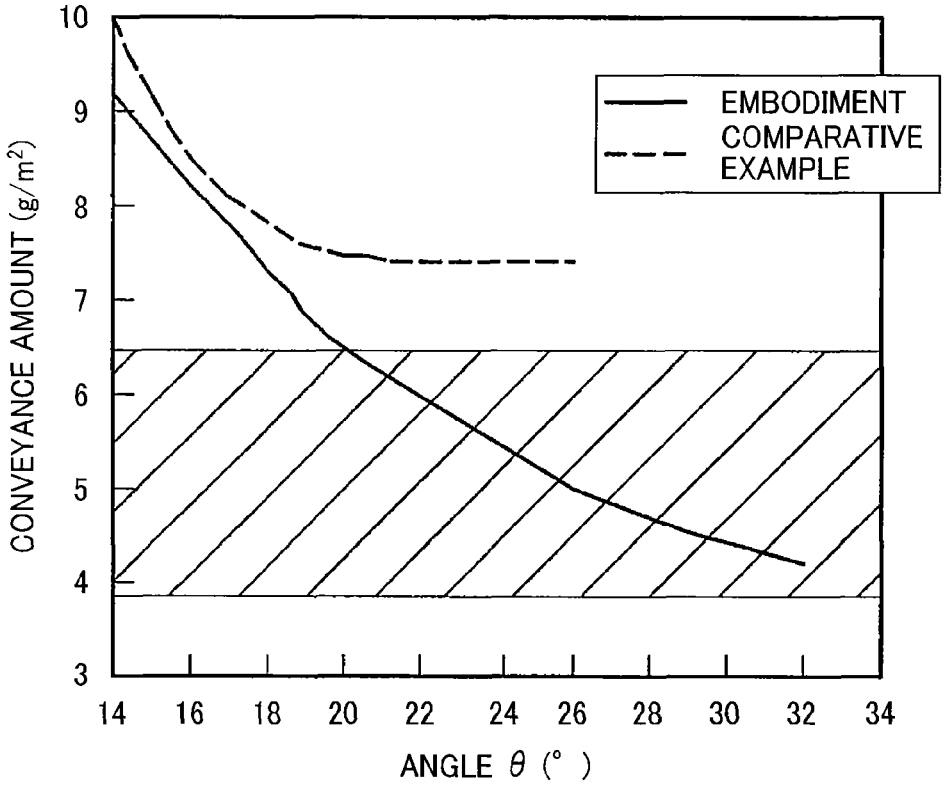
FIG. 7B is a graph showing test results, when the regulating pressure is set to a lower limit.

FIG. 7B shows the test results in the case where the pressure (refer to a hollow arrow in FIG. 5) applied to the developing roller 42 by the developer regulator 43 is set to 30 N (lower limit), and the solid line curve is drawn by plotting measurements of the toner conveyance amount of Embodiment, and the broken line curve is drawn by plotting measurements of the toner conveyance amount of Comparative Examples. In Embodiment, the toner conveyance amounts fall within the range of 4 to 6.5 g/m$^2$ at angles θ of 18° to 30°. In Comparative Examples, the toner conveyance amounts do not fall below 7 g/m$^2$ regardless of the angle θ.

Figure 8A:
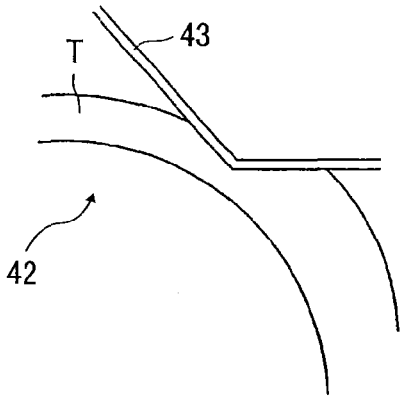
FIGS. 8A and 8B are cross-sectional views drawn by further simplifying FIG. 5, respectively indicating the case of deformed toner and the case of spherical toner.
Figure 8B:
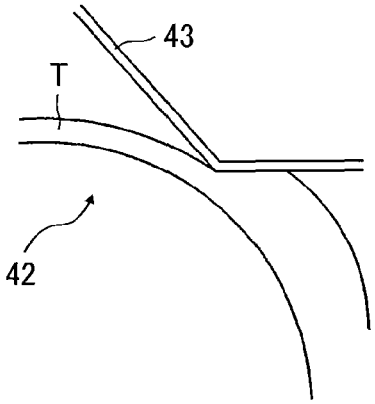

FIGS. 8A and 8B are simplified views for understanding that regulating effects vary depending on toner type when a layer thickness of toner is regulated by the developer regulator 43. FIG. 8A indicates the case of deformed toner, and FIG. 8B indicates the case of spherical toner. A layer thickness of the toner in the case of spherical toner is smaller than that of the toner in the case of deformed toner even though the same developer regulator 43 is used for both cases. The reason for this is thought as follows. That is, since each of deformed toner particles has many edges, the particles restrain one another. Therefore, it is difficult for such particles to move or to be displaced from one another (refer to FIG. 9A). On the other hand, spherical toner particles easily move or are easily displaced from one another (refer to FIG. 9B). Such fluidity of spherical toner is further promoted by employing oil-containing silica as an external additive.

Figure 9A:
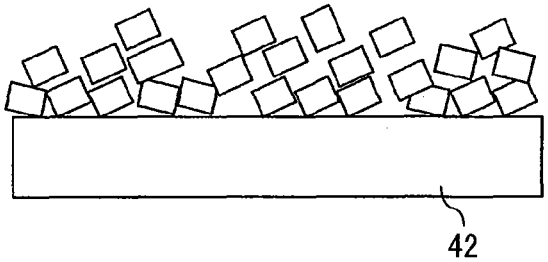
FIGS. 9A and 9B are schematic views of toner on the developing roller, respectively indicating the case of deformed toner, and FIG. 9(B) indicates the case of spherical toner.
Figure 9B:
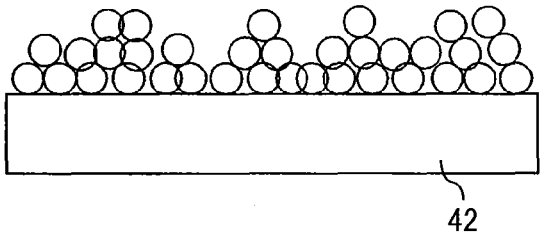

It is to be noted that FIG. 9A is exaggeratingly drawn with the deformed toner illustrated into a simple tetragon, but it is actually an indefinite shape having many edges and depressions. The shape and size of toner particles vary among toner particles. The reason why the deformed toner particle is deformed is that the toner is a pulverized toner produced by so-called pulverization, in which a main raw material and auxiliary material are melted and kneaded, and then the resulting mixture is pulverized and classified. On the other hand, the spherical toner shown in FIG. 9B is a polymerized toner produced by polymerization. It is nearly a true sphere (expressed by the average circularity, for example, it can be defined as "0.98 or more").

Figure 10A:
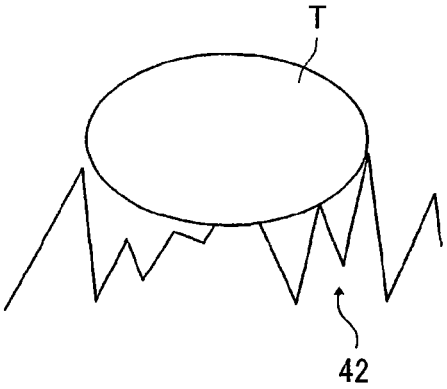
FIG. 10A is an enlarged schematic view of toner on a grinding-type developing roller according to a comparative example.
Figure 10B:
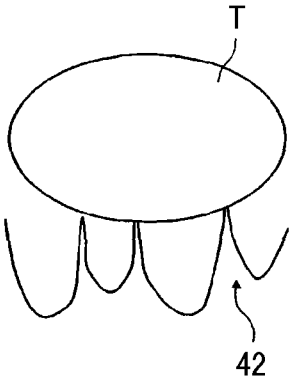
FIG. 10B is an enlarged schematic view of toner on a roller having a surface in which recesses are formed, according to an embodiment.

FIGS. 10A and 10B illustrate a relationship between the finish of the surface of the developing roller 42 and the fluidity of the toner particle. FIG. 10A indicates, as Comparative Example, the case where the projections and depressions are formed in the surface of the developing roller 42 by grinding. Since such a grinding-type roller has a distribution of grooves (valleys) and a distribution of projections (peaks), large coarse particles tend to be held between peaks, and it is possible that such coarse particles make the developer regulator 43 forcibly pass through. FIG. 10B indicates, as Embodiment, the case where the recesses are formed. For example, the surface roughness Ra thereof is 1.0 to 2.0 μm, the surface area ratio is 2.0 to 4.0, and the cross-sectional void rate of recesses is 50% or less. Since such recesses are toner-sized and have a relatively constant height compared with grinding-type rollers, a large extraneous substance is hardly held.

Table 7 shows the measurement results of how the toner conveyance amount varies by varying the angle θ and the length L1 of the bent tip portion 43-1 of the developer regulator 43.

TABLE 7

| | L1 (mm) | | | | |
|---|---|---|---|---|---|
| | 0.2 | 0.3 | 0.4 | 0.5 | 0.6 |
| θ = 20° | 4.5 | 5.1 | 5.5 | 5.8 | 7 |
| θ = 30° | 3.2 | 4 | 4.3 | 4.7 | 6 |

The toner used in the test was toner for IPSiO SPC 731 manufactured by Ricoh Company, Ltd., and the pressure (refer to a hollow arrow in FIG. 5) applied to the developing roller 42 by the developer regulator 43 was set to 45 N. The results of the test are as follows. That is, when the bending angle θ is 20°, the target value of the toner conveyance amount is satisfied in the range of L of 0.2 to 0.5 mm. When the bending angle θ is 30°, the target value of the toner conveyance amount is satisfied in the range of L of 0.3 to 0.6 mm. Therefore, when the bending angle θ is changed between 20° and 30°, the length L1 is preferably set within the range of 0.3 to 0.5 mm.

Table 8 shows measurements results showing how the number of streaks generated on the thin layer varies depending on the proportions of coarse powder having a particle diameter of 16 μm or greater.

TABLE 8

| Content of coarse powder (%) | Number of streaks | | | |
|---|---|---|---|---|
| | Initial printing | 1000 sheets | 3000 sheets | 5000 sheets |
| 4 | 10 | 50 | Greater than 100 | Greater than 100 |
| 2 | 0 | 0 | 10 | 20 |
| 1 | 0 | 0 | 0 | 0 |

In this case, it can also be said that the number of streaks represents the number of clogging. A spherical toner (toner for IPSiO SPC 731 manufactured by Ricoh Company, Ltd.) having an average particle diameter of 6 μm was used for samples, and the amount of the coarse powder was changed to 4%, 2% and 1% by classification. With respect to other test conditions, the pressure (refer to a hollow arrow in FIG. 5) by the developer regulator 43 was set to 45 N, the length L1 of the tip portion of the developer regulator 43 was set to 0.4 mm, and the bending angle θ of the developer regulator 43 was set to 25°. The results of the test are as follows. When the amount of the coarse powder was 1%, the streak was not generated after 5000 sheets of print. When the amount of the coarse powder was 2%, 10 streaks were generated after 3000 sheets of print, and 20 streaks were generated after 5000 sheets of print. When the amount of the coarse powder was 4%, 10 streaks were already generated at the initial stage of print, 50 streaks after 1000 sheets, 100 or more streaks after 3000 sheets, and also 100 or more streaks after 5000 sheets of print.

The embodiment described above can attain the following effects.

A developing device according to the embodiment includes a toner bearer, such as the developing roller 42, a toner supply member, such as the supply roller 44 to supply toner to the toner bearer, the developer regulator 43 opposed to the toner bearer 42 or disposed in contact with the toner bearer to regulate the thickness of a toner layer on the toner bearer, and a toner containing compartment to store toner. In this configuration, polymerized toner is used, the upper limit of weight average particle diameter of toner particles is 8.0 μm, and the average circularity thereof is 0.98 or more. Multiple recesses are formed in the surface of the toner bearer, the toner bearer has a surface roughness Ra from 1.0 to 2.0 μm. The surface area ratio is 2.0 to 4.0, and the upper limit of the cross-sectional void rate of recesses is 50%. A tip of the developer regulator 43 is bent, and the amount ($g/m^2$) of toner conveyed is adjusted by a bending angle θ of the tip of the developer regulator 43.

Use of the above-described spherical toner and setting of the angle θ of the developer regulator 43 can make image density controllable although, in cases of toner bearers having multiple recesses formed in the surface thereof, it tends to become uncontrollable due to an excessive toner conveyance amount.

In the case of deformed toner, the toner conveyance amount changes steeply when the angle of the developer regulator 43 is small, and the toner conveyance amount is stable when the angle of the developer regulator 43 becomes a certain angle (refer to FIG. 6 and FIG. 7). The reason for this is believed to be that even when the angle θ is increased to make it hard to take in the toner, a certain amount of the toner is conveyed since the deformed toner hardly moves. Here, in the case of a roller having multiple recesses formed in the surface, the toner conveyance amount becomes excessive under the condition in which the roller has the effect of scraping off. Therefore, employing spherical toner is advantageous in that passage of toner through the developer regulator 43 depends on the intake property of the bending angle at the tip of the developer regulator 43, and the toner conveyance amount varies. As a result, the toner conveyance amount can become smaller as described above.

The excessive conveyance amount can be suppressed by setting the bending angle θ of the tip of the developer regulator 43 within the range of 16° to 30°. It is found from the results of experiments that the optimum range of the angle θ, in which the excessive conveyance amount can be suppressed, is 18° to 30° when the target conveyance amount is set to 4 to 6 $g/m^2$. Needless to say, when the target conveyance amount is changed, a preferable range of the angle θ varies according to the change since the above-described range of optimum angle θ is for the case in which the target conveyance amount is set to the range from 4 to 6 $g/m^2$.

A moderate conveyance amount can be attained by setting the length L1 of the bent tip portion 43-1 of the developer regulator 43 within the range of 0.3 to 0.5 mm (refer to Table 7).

The toner is adjusted so that the content of toner particles or extraneous material particles having a particle diameter of 16 μm or greater is 2% in a particle diameter distribution on a number basis (refer to Table 8). When the bending angle θ of the tip of the developer regulator 43 is increased, coarse powder particles tend to get stuck and bitten when the coarse powder approaches to the developer regulator 43. Particularly, since the developing roller 42 having multiple recesses formed in the surface has the lower capability of conveying coarse powder and transporting through the regulation gap than typical grinding type rollers, coarse substances in the toner is reduced. In this case, improvements are possible when the ratio of toner particles or extraneous particles having a particle diameter of 8 μm or greater is adjusted to 10% or less.

Further, employing oil-containing silica as the external additive of the toner can further increase the fluidity of the toner, thereby further facilitating adjustment of toner conveyance amount by the action of the developer regulator 43.

According to the embodiment described above, it is possible to suppress adhesion of the adhesion-causing substance to the developer regulator while suppressing the excessive conveyance amount of toner.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a toner bearer including a surface in which multiple recesses having a cross-sectional void rate of 50% or smaller are formed, the toner bearer having a surface roughness Ra within a range from 1.0 μm to 2.0 μm and a surface area ratio within a range from 2.0 to 4.0;

a toner supply member to supply toner to the toner bearer; and a developer regulator disposed facing or in contact with the toner bearer to adjust a layer thickness of toner carried on the toner bearer, the developer regulator including a bent tip portion, wherein the toner is polymerized toner having a weight average particle diameter of 8.0 μm or smaller and an average circularity of 0.98 or greater.

2. The developing device according to claim 1, wherein a bending angle of the bent tip portion of the developer regulator is within a range from 16 degrees to 30 degrees.

3. The developing device according to claim 1, wherein the bent tip portion of the developer regulator has a length within a range from 0.3 mm to 0.5 mm in a direction perpendicular to a longitudinal direction of the toner bearer.

4. The developing device according to claim 1, wherein, in the toner, a content of coarse particles having a particle diameter of 16 μm or greater is 2% or less in a number basis particle diameter distribution.

5. The developing device according to claim 1, wherein the toner comprises oil-containing silica as an external additive.

6. A process unit removably installed in an image forming apparatus, the process unit comprising:

a latent image bearer on which a latent image is formed; and a developing device to develop the latent image, housed in a common unit casing together with the latent image bearer, the developing device comprising:

a toner bearer including a surface in which multiple recesses having a cross-sectional void rate of 50% or smaller are formed, the toner bearer having a surface roughness Ra within a range from 1.0 μm to 2.0 μm and a surface area ratio within a range from 2.0 to 4.0;

a toner supply member to supply toner to the toner bearer; and a developer regulator disposed facing or in contact with the toner bearer to adjust a layer thickness of toner carried on the toner bearer, the developer regulator including a bent tip portion to adjust a toner conveyance amount on the toner bearer, wherein the toner is polymerized toner having a weight average particle diameter of 8.0 μm or smaller and an average circularity of 0.98 or greater.

7. An image forming apparatus comprising:

a latent image bearer;

a latent image forming unit to form a latent image on the latent image bearer; and a developing device to develop the latent image bearer, the developing device comprising:

a toner bearer including a surface in which multiple recesses having a cross-sectional void rate of 50% or smaller are formed, the toner bearer having a surface roughness Ra within a range from 1.0 μm to 2.0 μm and a surface area ratio within a range from 2.0 to 4.0;

a toner supply member to supply toner to the toner bearer; and a developer regulator disposed facing or in contact with the toner bearer to adjust a layer thickness of toner carried on the toner bearer, the developer regulator including a bent tip portion to adjust a toner conveyance amount on the toner bearer, wherein the toner is polymerized toner having a weight average particle diameter of 8.0 μm or smaller and an average circularity of 0.98 or greater.

* * * * *